US006860180B1

(12) United States Patent
Liao et al.

(10) Patent No.: US 6,860,180 B1
(45) Date of Patent: Mar. 1, 2005

(54) SCREWDRIVER PROVIDED WITH PERCUSSION MECHANISM TO FACILITATE THE UNFASTENING AND THE FASTENING OF SCREW

(76) Inventors: Chien-Hsia Liao, No. 14, Yisin 2th St., Taiping, Taichung (TW); Pei-Shan Li, No. 22-1, Lane 171, Wunsin S. 6th Rd., Taichung City (TW)

( * ) Notice: Subject to any disclaimer, the term of this patent is extended or adjusted under 35 U.S.C. 154(b) by 0 days.

(21) Appl. No.: 10/699,216

(22) Filed: Oct. 31, 2003

(51) Int. Cl.[7] ..... B25B 19/00
(52) U.S. Cl. ..... 81/465; 81/492
(58) Field of Search ..... 81/465, 466, 492, 81/58.1, 463; 173/93

(56) References Cited

U.S. PATENT DOCUMENTS 4,858,504 A * 8/1989 Tsai ..... 81/436
5,012,709 A * 5/1991 Su ..... 81/466
6,250,187 B1 * 6/2001 Ju et al. ..... 81/463
6,647,837 B2 * 11/2003 Liou ..... 81/466

* cited by examiner

*Primary Examiner*—Jacob K. Ackun, Jr.
(74) *Attorney, Agent, or Firm*—W. Wayne Liauh

(57) ABSTRACT

A screwdriver comprises a handle and a shank. The handle is provided at a head end with a percussion block. The shank is put through the interior of the handle such that one end of the shank is fastened with the percussion block, and that other end of the shank is extended out of other end of the handle. The shank is provided on the other end thereof with a percussion-rotation mechanism which is in turn fastened with a tip. The mechanism enables the tip to turn instantaneously at the time when the percussion block is impacted.

6 Claims, 14 Drawing Sheets

SCREWDRIVER PROVIDED WITH PERCUSSION MECHANISM TO FACILITATE THE UNFASTENING AND THE FASTENING OF SCREW

FIELD OF THE INVENTION

The present invention relates generally to a screwdriver, and more particularly to a screwdriver which is provided with a percussion mechanism to facilitate the unfastening of a badly rusted screw that can not be otherwise driven with ease.

BACKGROUND OF THE INVENTION

As shown in FIGS. 1 and 2, a prior art screwdriver comprises a plastic handle 1 and a shank 4. The handle 1 is provided at one end with a fastening hole 3 which is in turn provided with a plurality of retaining slots 2. The shank 4 is provided in the outer surface with a plurality of retaining projections 5 and is fastened with the handle 1 such that the retaining projections 5 are retained in the retaining slots 2 of the fastening hole 3. This prior art screwdriver is not effective in driving a badly rusted screw due to the lack of a percussion mechanism. In addition, the plastic handle 1 is not adapted to impact which is intended to help drive the badly rusted screw.

As shown in FIGS. 3 and 4, a prior art screwdriver comprises a handle 6 and a blade 10. The handle 6 is provided at a head end thereof with a metal body 7 which is provided at a fastening end 8 with a fastening hole 9 for fastening one end of the blade 10. The metal body 7 is used for percussion purpose in the event that the prior art screwdriver encounters with difficulty in driving a badly rusted screw. However, the metal body 7 is not an effective percussion mechanism.

As shown in FIGS. 5 and 6, a prior art screwdriver comprises a handle 11 and a tool head 15. The handle 11 is made of metal by machining. The tool head 15 is fastened at one end with a fastening end of the handle 11 in conjunction with a compression spring 14 which is located in a locating hole 12 of the fastening end of the handle 11. A locating pin 16 is used to locate the tool head 15 such that the locating pin 16 is retained in a retaining through hole 17 of the tool head 15 and one of the two V-shaped slots 13. When the handle 11 is impacted, the spring 14 is compressed by a reaction force of the tool head 15. In the meantime, the pin 16 moves downwards to arrive at the bottom point of the V-shaped slot 13. Subsequently, the pin 16 is caused by the spring force of the spring 14 to displace upwards, as shown in FIG. 7. Such a movement of the pin 16 along the V-shaped path brings about a rotating effect on a screw to be driven. In light of the handle 11 being made of metal, the prior art screwdriver is rather heavy and can not be easily maneuvered.

SUMMARY OF THE INVENTION

The primary objective of the present invention is to provide a screwdriver which is free of the deficiencies of the prior art screwdrivers described above.

In keeping with the principle of the present invention, the foregoing objective of the present invention is attained by a screwdriver comprising a handle and a shank. The handle is provided at a head end with a percussion block, which is fastened with one end of the shank. The shank is fastened at other end with a percussion-rotation mechanism, which is activated to actuate a tip to turn, so as to facilitate the driving of a screw by the tip. The handle of the present invention is made of a plastic material by injection molding and is therefore relatively light in weight.

The features and the advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
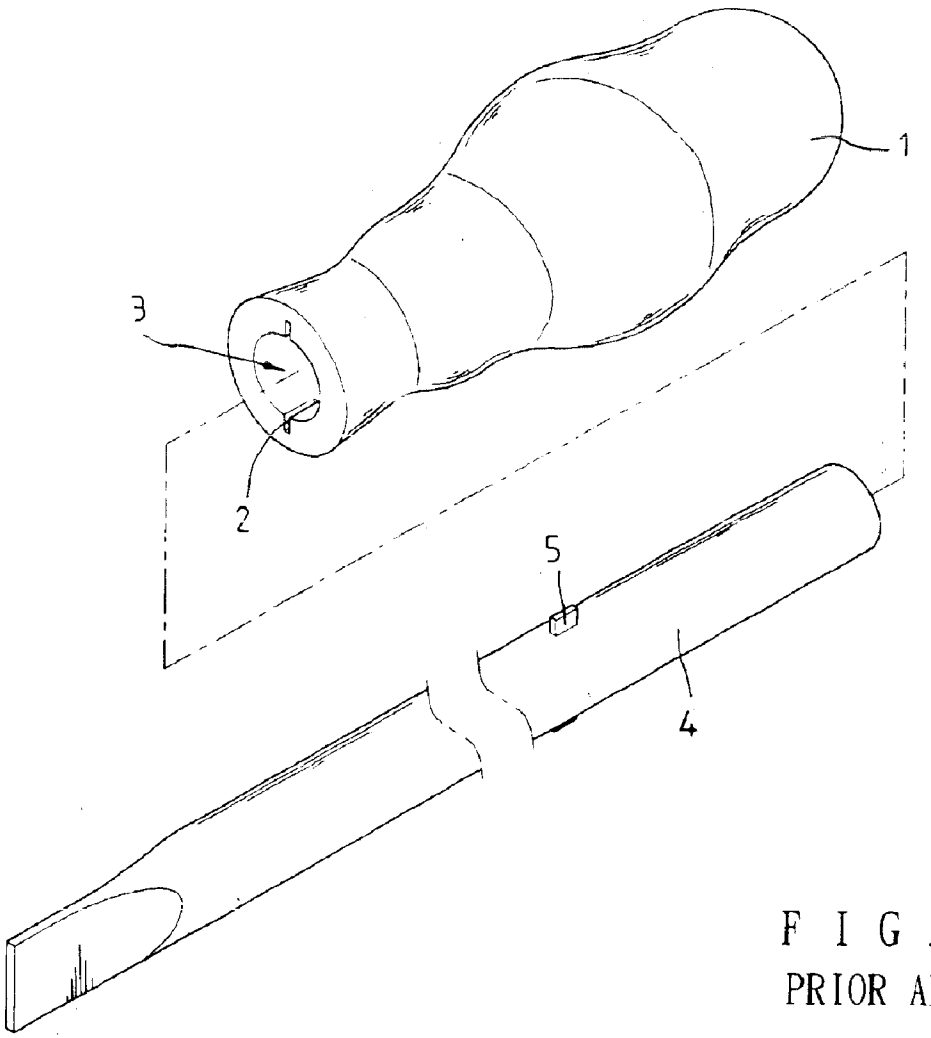
FIG. 1 PRIOR ART
FIG. 1 shows an exploded view of a first prior art screwdriver.
Figure 2:
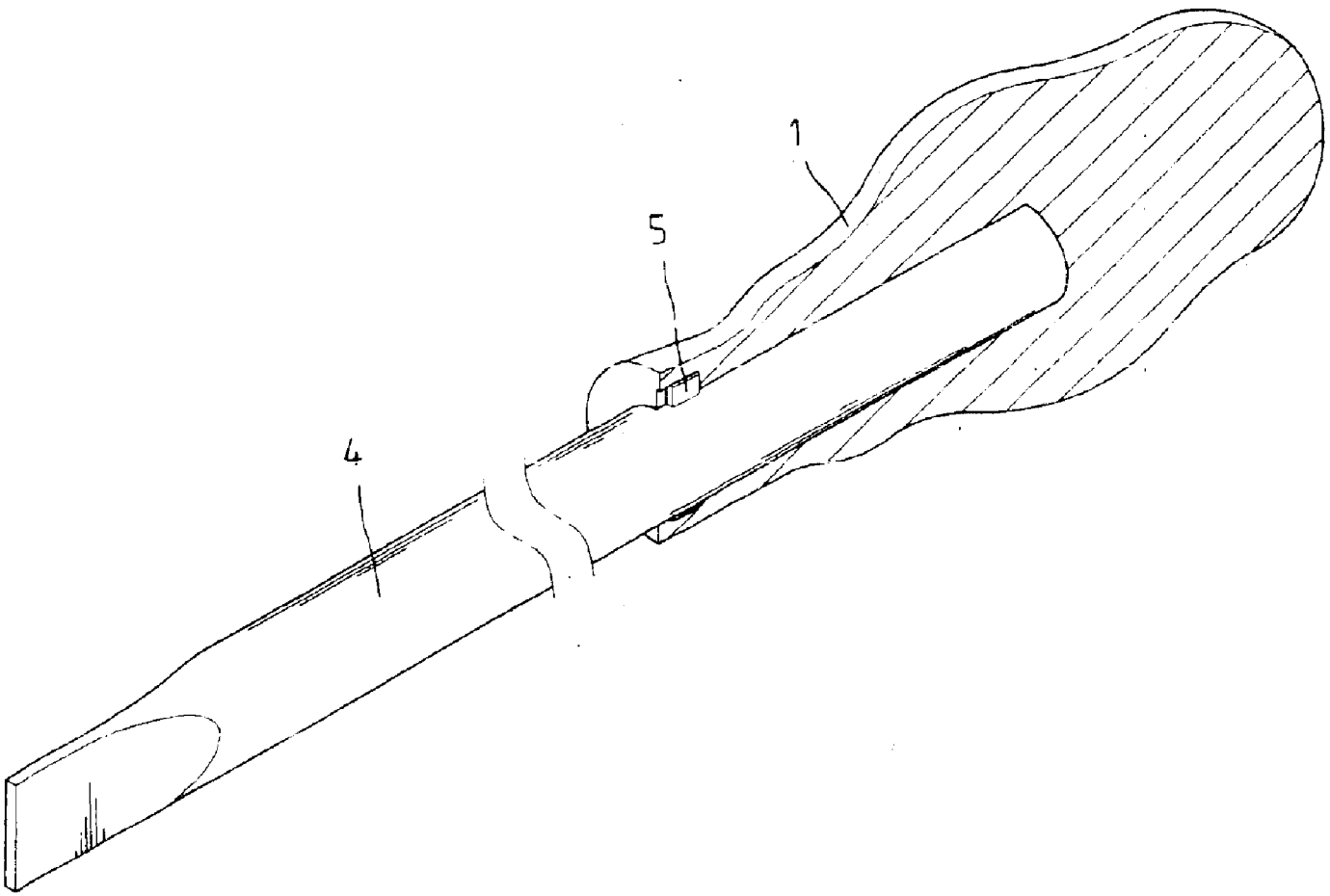
FIG. 2 PRIOR ART
FIG. 2 shows a sectional schematic view of the first prior art screwdriver in combination.
Figure 3:
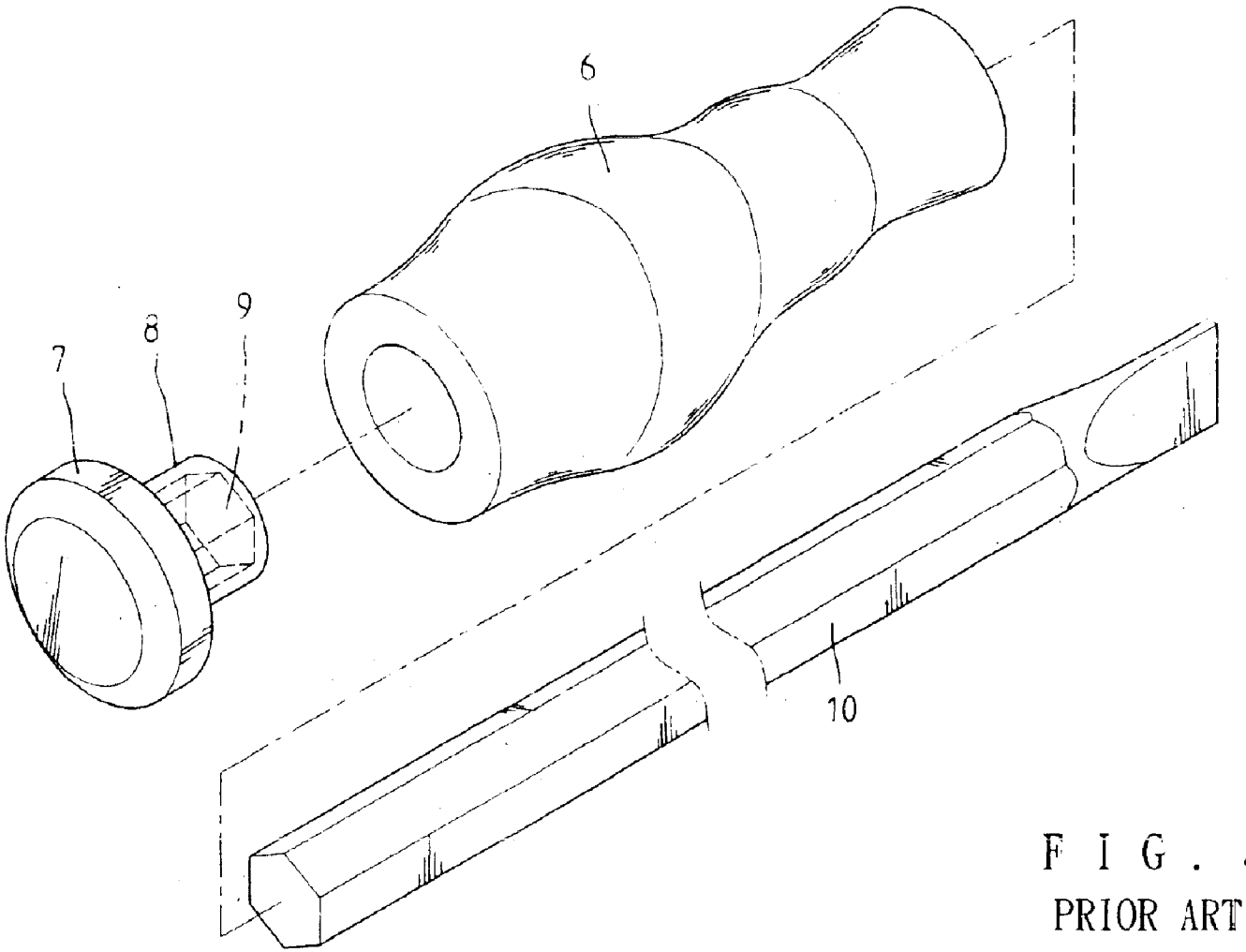
FIG. 3 PRIOR ART
FIG. 3 shows an exploded view of a second prior art screwdriver.
Figure 4:
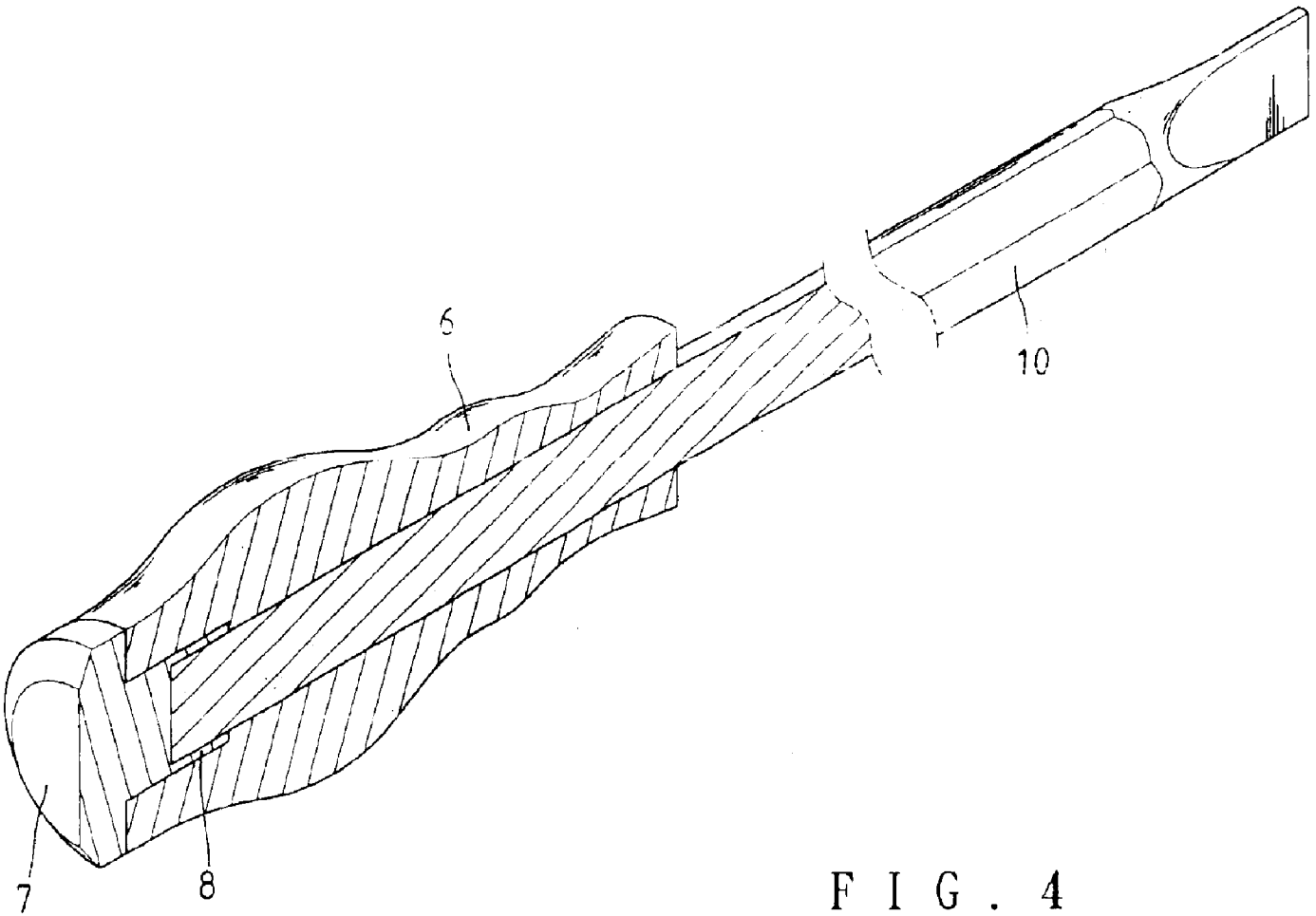
FIG. 4 PRIOR ART
FIG. 4 shows a sectional schematic view of the second prior art screwdriver in combination.
Figure 5:
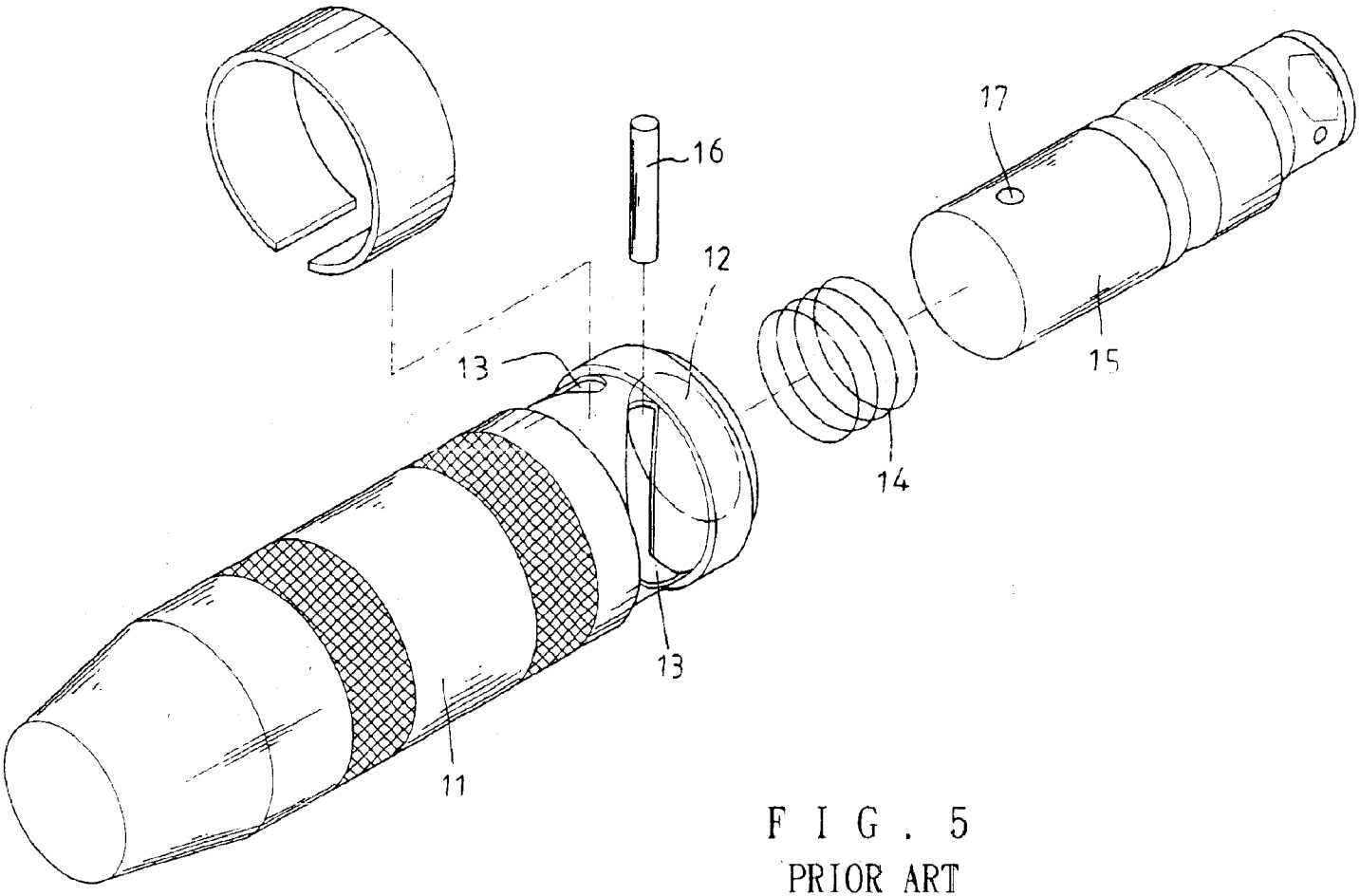
FIG. 5 PRIOR ART
FIG. 5 shows an exploded view of a third prior art screwdriver.
Figure 6:
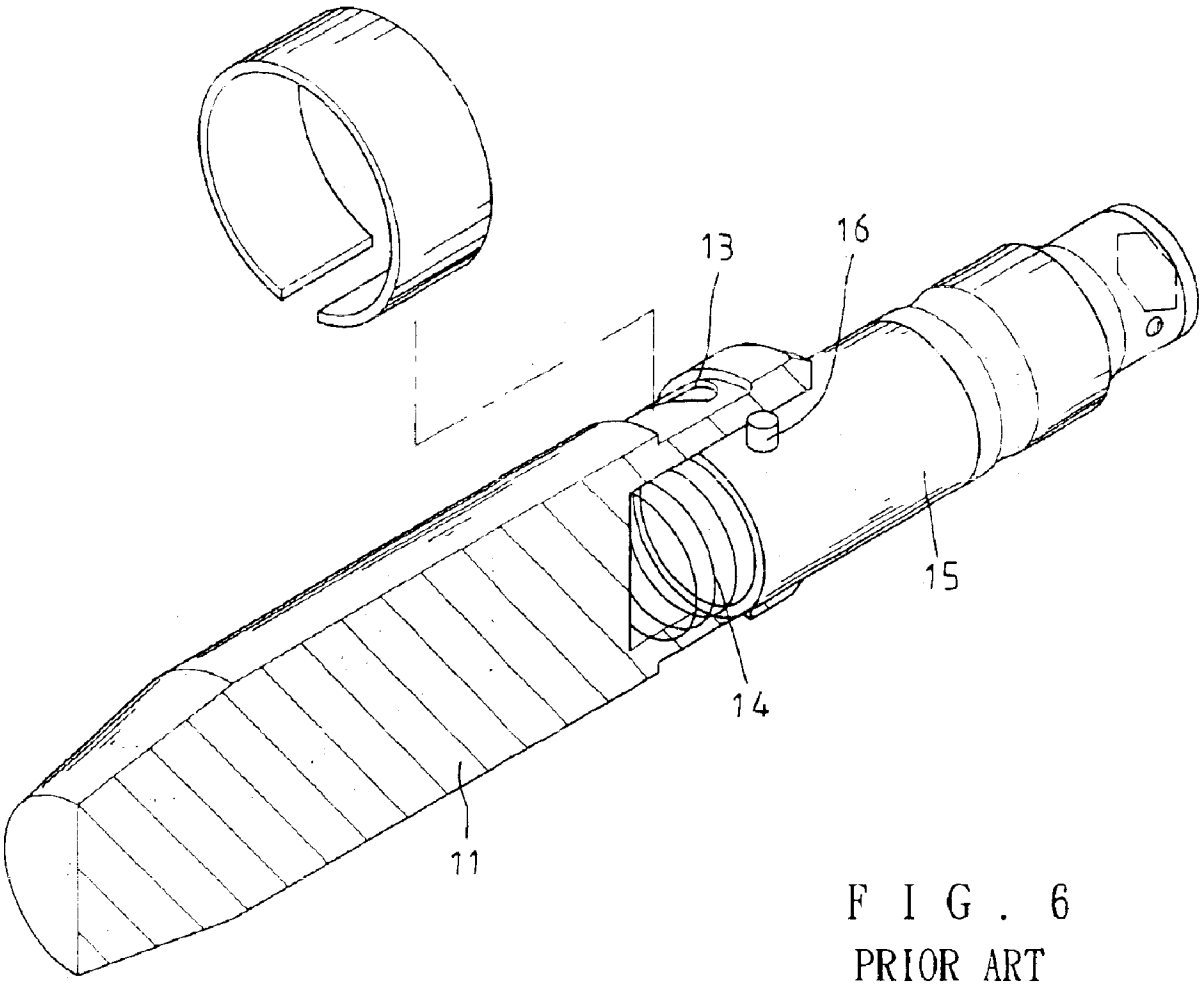
FIG. 6 PRIOR ART
FIG. 6 shows a sectional schematic view of the third prior art screwdriver in combination.
Figure 7:
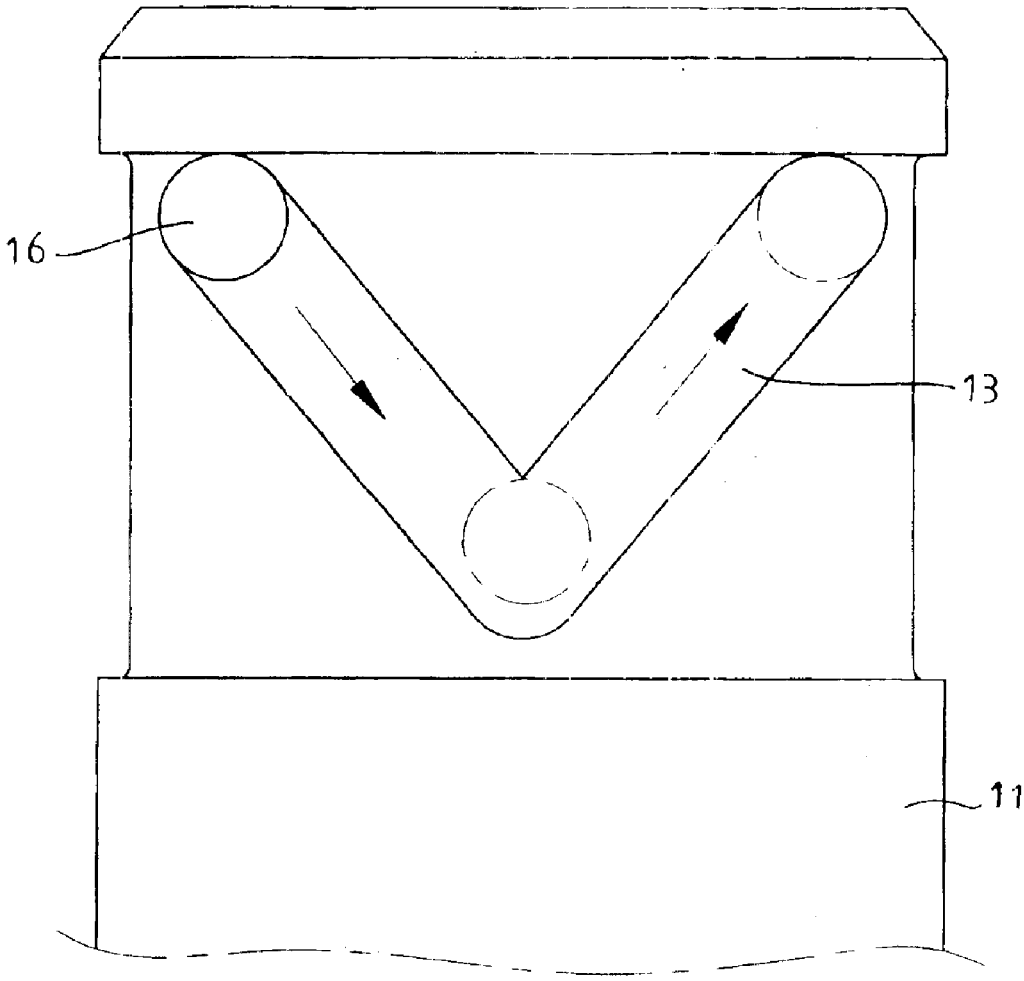
F I G . 7 PRIOR ART
FIG. 7 shows a schematic view of the third prior art screwdriver at work.
Figure 8:
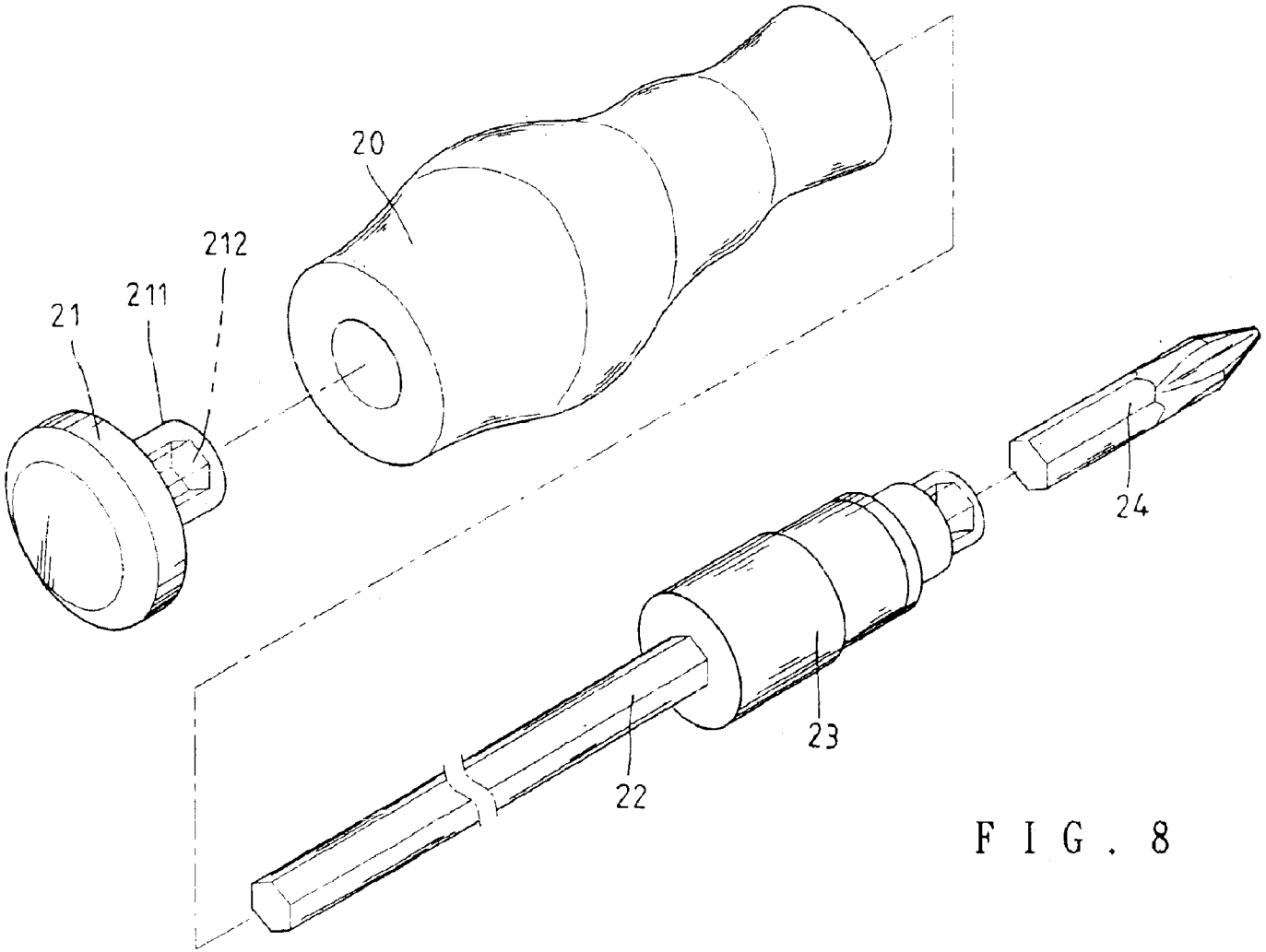
FIG. 8 shows an exploded view of the preferred embodiment of the present invention.

As shown in FIG. 8, a screwdriver of the present invention comprises a handle 20, a percussion block 21 fastened to a head end of the handle 20, a shank 22, a percussion-rotation mechanism 23, and a tip 24.

The percussion block 21 is provided with a fastening portion 211 which is provided with a fastening hole 212 in which one end of the shank 22 is fastened. The percussion-rotation mechanism 23 is fastened with other end of the shank 22. The tip 24 is fastened with the percussion-rotation mechanism 23.

The handle 20 is made of a plastic material by injection molding and is therefore relatively light in weight.

Figure 9:
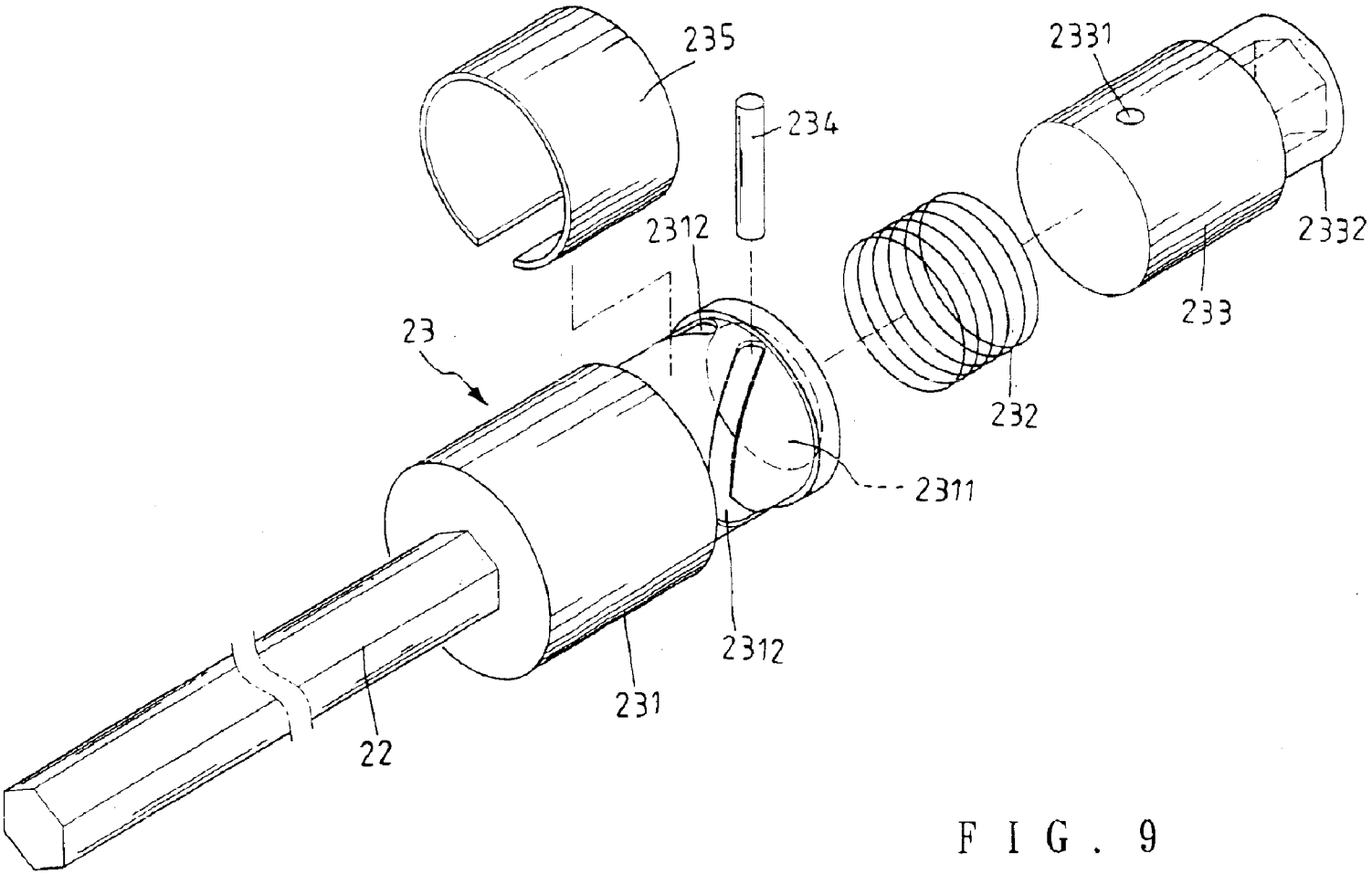
FIG. 9 shows an exploded view of the percussion-rotation mechanism of the preferred embodiment of the present invention.
Figure 10:
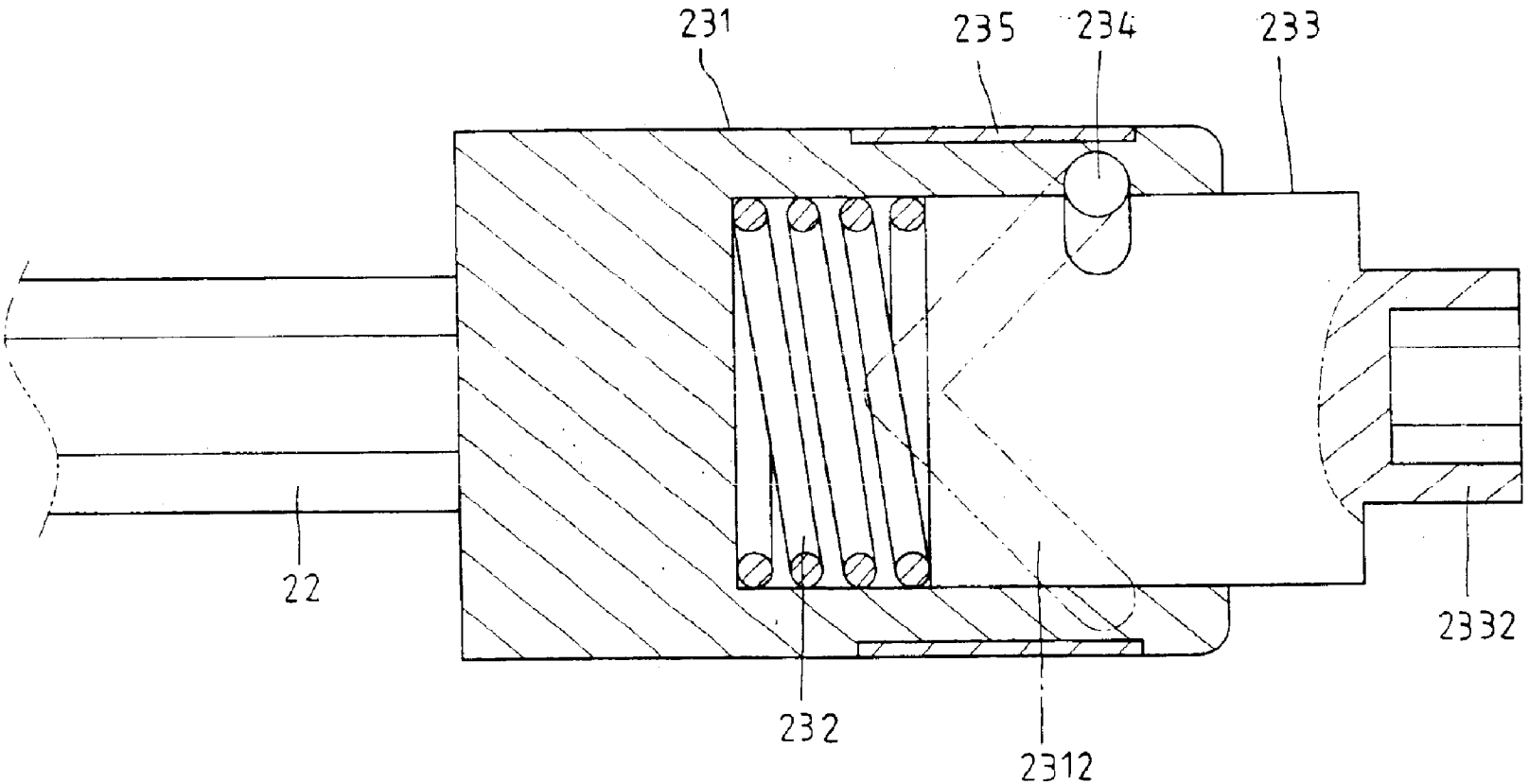
FIG. 10 shows a sectional schematic view of the percussion-rotation mechanism of the preferred embodiment of the present invention.

As shown in FIGS. 9 and 10, the percussion-rotation mechanism 23 comprises a mounting block 231, which is provided with a fitting hole 2311, and two V-shaped slots 2312 opposite to each other and corresponding to the fitting hole 2311. The mechanism 23 further comprises a spring 232 and an action block 233, which are located in the fitting hole 2311. The action block 233 is provided with a through hole 2331 perpendicular to an axis of the action block 233, and a fastening portion 2332 for fastening the tip 24. In combination, the spring 232 and the action block 233 are disposes in the fitting hole 2311 of the mounting block 231 in conjunction with a pin 234 which is put through the through hole 2331 via one of the two V-shaped slots 2312 and then through other one of the two V-shaped slots 2312. As a result, the action block 233 is fastened with the mounting block 231 by the pin 234 which is prevented from escaping by the displacement of the compression spring 232. The spring 232 is confined by a confinement ring 235.

Figure 11:
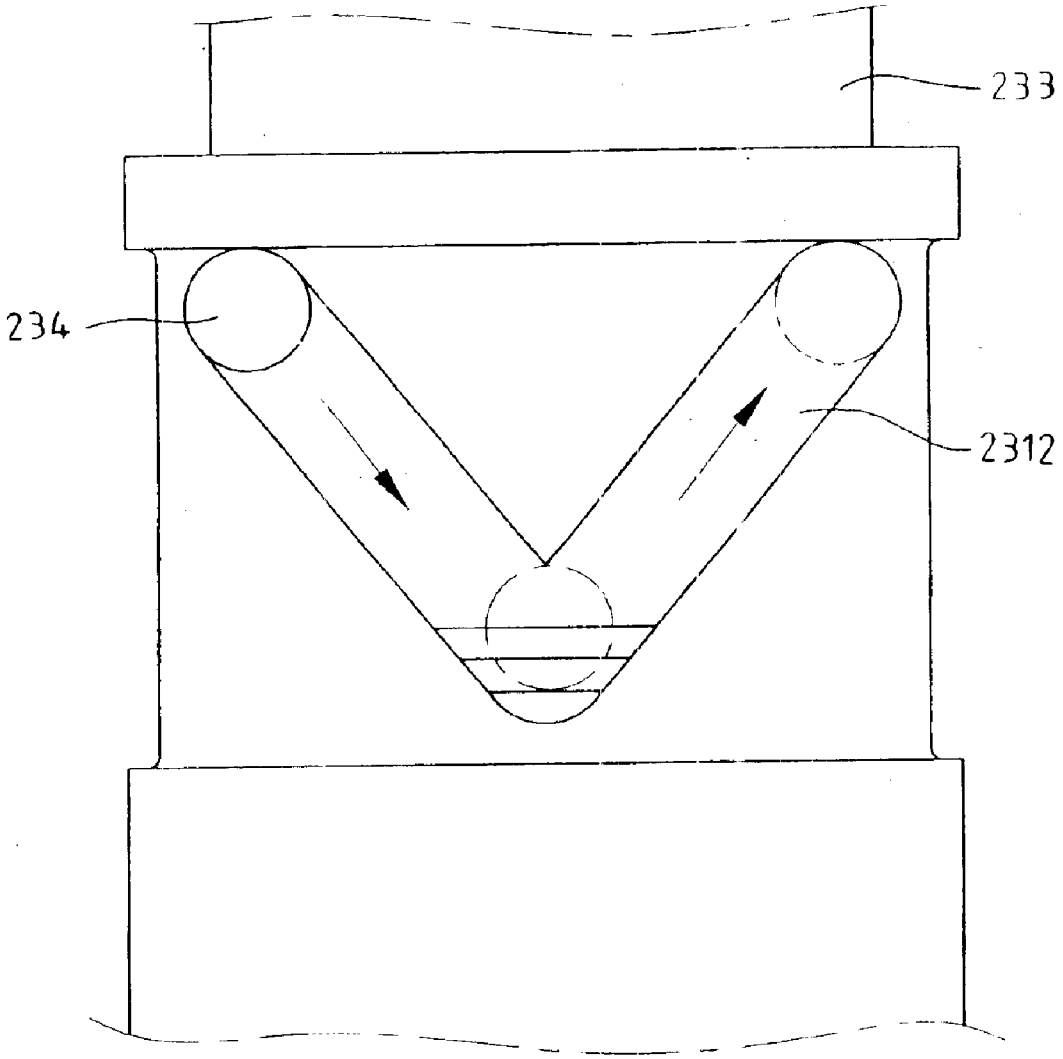
FIG. 11 shows a schematic view of the percussion-rotation mechanism of the present invention in action.

As shown in FIG. 11, when the pin 234 moves along the V-shaped slot 2312, the path of the V-shaped slot 2312 includes a displacement of horizontal movement. In another words, when the action block 233 is caused by the impact and the spring force to displace, the action block 233 is instantaneously engaged in a rotational movement. As a result, a badly rusted screw is easily driven.

Figure 12:
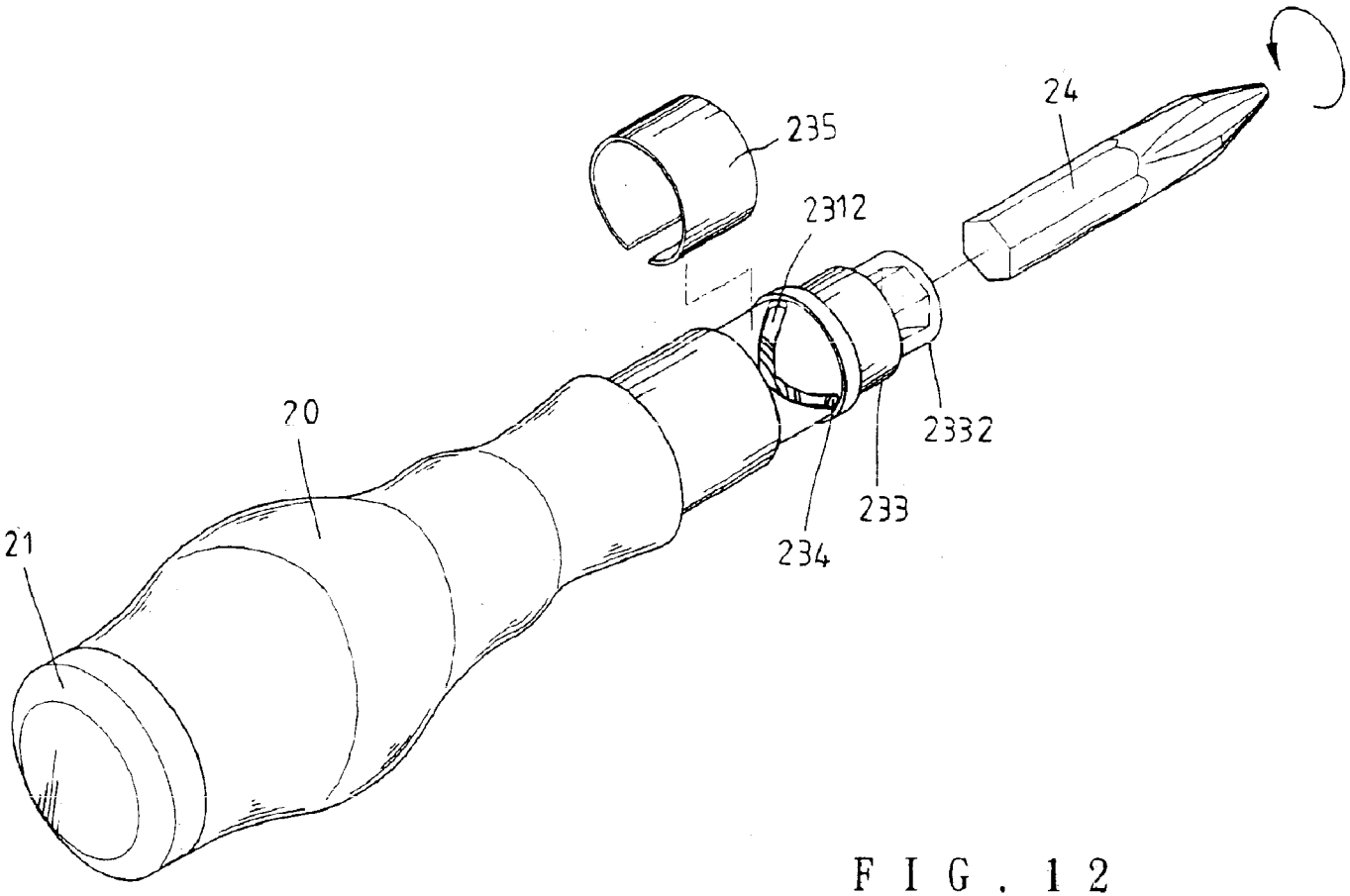
FIG. 12 shows a schematic view of the preferred embodiment of the present invention at work.

As shown in FIG. 12, the present invention is used to unfasten a badly rusted screw. The pin 234 is located at a lower initial end of the outer V-shaped slot 2312. As a result of percussion, the pin 234 moves upwards along the V-shaped slot 2312, thereby causing the action block 233 to turn counterclockwise. The screw is thus unfastened.

Figure 13:
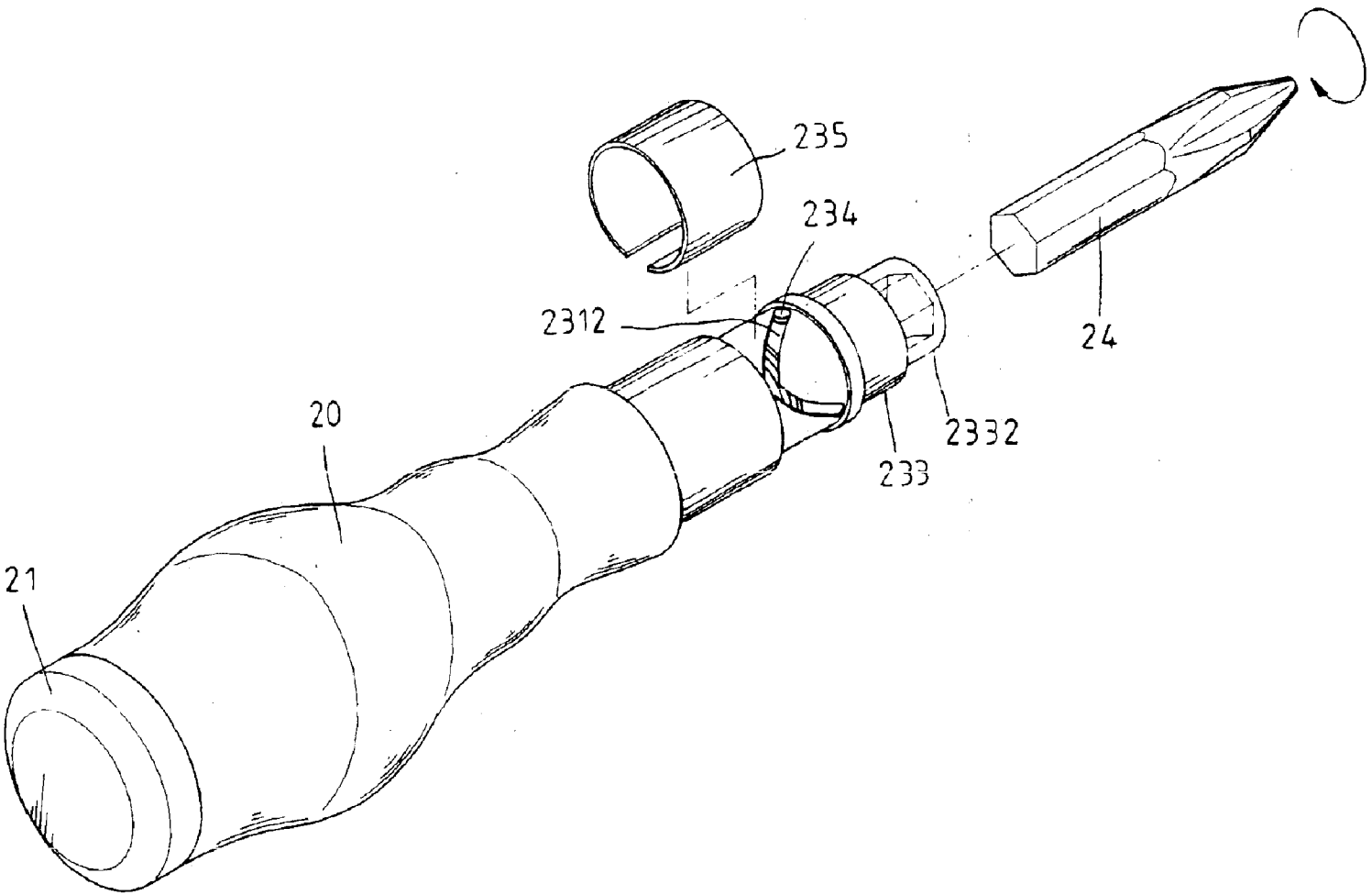
FIG. 13 shows another schematic view of the preferred embodiment of the present invention at work.

As shown in FIG. 13, the present invention is used to fasten a screw. The action block 233 is pressed to cause the pin 234 to locate at an upper initial end of the outer V-shaped slot 2312. As a result of percussion, the pin 234 moves downwards along the V-shaped slot 2312, thereby enabling the action block 234 to turn clockwise. The screw is thus fastened.

Figure 14:
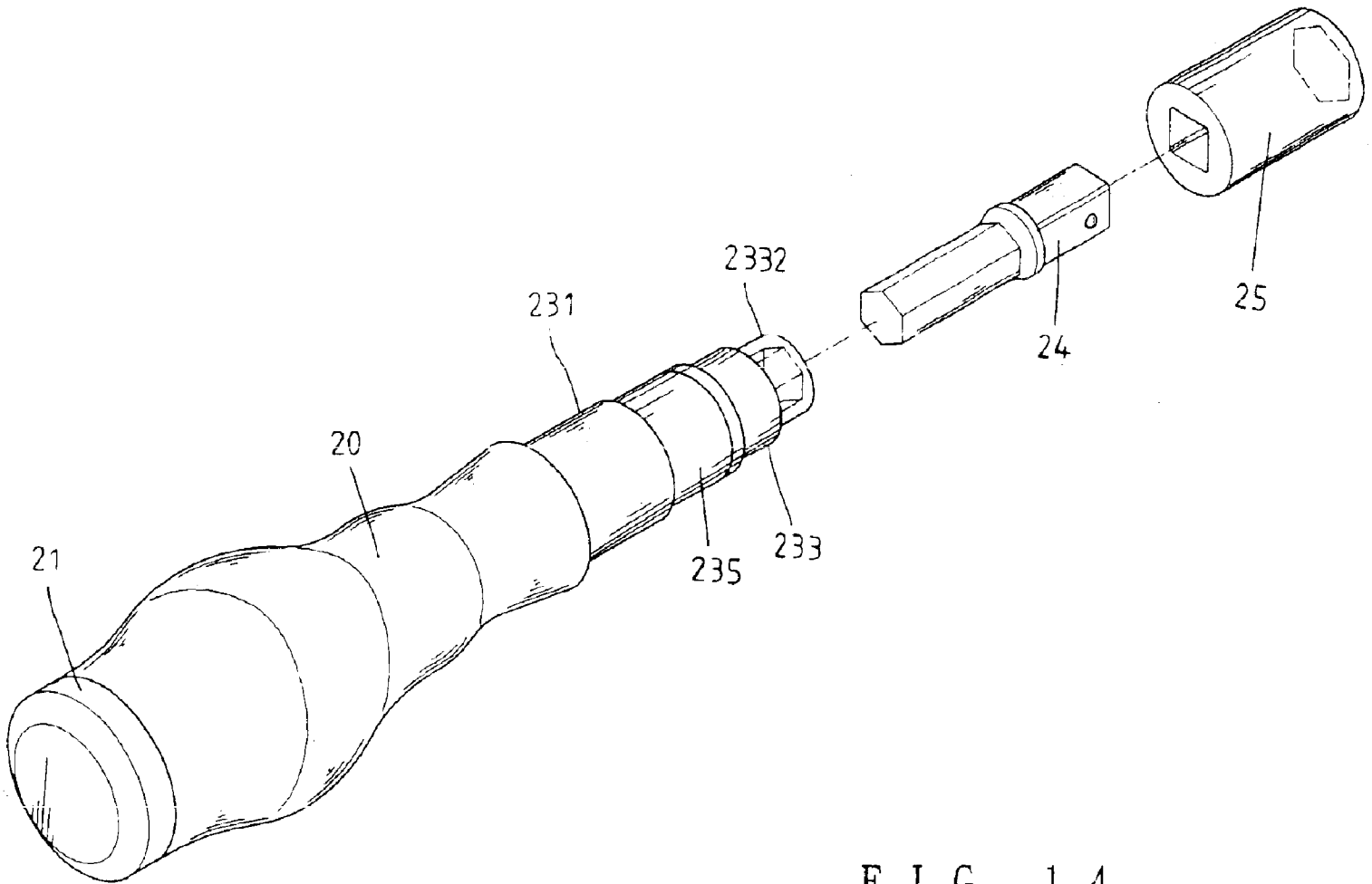
FIG. 14 shows a schematic view of the application of the preferred embodiment of the present invention in conjunction with a socket.

As shown in FIG. 14, the action block 233 is also engageable with a socket 25 in conjunction with a connection rod 24 which is fastened at one end with the fastening portion 2332 of the action block 233, and at other end with the socket 25.

The embodiment of the present-invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A screwdriver comprising:

a handle;

a metal percussion block fastened with a head end of said handle;

a shank put through an interior of said handle such that one end of said shank is fastened with said percussion block; and a percussion-rotation mechanism fastened with other end of said shank and provided with a fastening portion for fastening a tip.

2. The screwdriver as defined in claim 1, wherein said percussion block has a fastening portion and a percussion portion greater in diameter than said fastening portion; wherein said shank is fastened at the one end thereof with said fastening portion of said percussion block.

3. The screwdriver as defined in claim 1, wherein said percussion-rotation mechanism comprises:

a mounting block fastened at one end with said shank and provided at other end with a fitting hole and two V-shaped slots opposite to each other and corresponding to said fitting hole;

a spring located in said fitting hole of said mounting block; and an action block located in said fitting hole of said mounting block such that said spring is compressed by said action block, said action block provided with a through hole corresponding to said V-shaped slots, a pin, and a fastening portion, with said pin being received in said through hole such that both ends of said pin are located in said V-shaped slots, thereby enabling said action block to slide along said V-shaped slots of said mounting block whereby said fastening portion of said action block is fastened with said tip.

4. The screwdriver as defined in claim 3, wherein said V-shaped slots of said mounting block are provided with a confinement ring for confining said pin of said action block.

5. The screwdriver as defined in claim 1, wherein said fastening portion of said percussion-rotation mechanism is engageable with a socket in conjunction with a connection rod whereby said connection rod is fastened at one end with said fastening portion, and at other end with said socket.

6. The screwdriver as defined in claim 3, wherein said fastening portion of said action block is engageable with a socket in conjunction with a connection rod whereby said connection rod is fastened at one end with said fastening portion, and at other end with said socket.

* * * * *